US007089652B2

(12) United States Patent
Akhtman et al.

(10) Patent No.: US 7,089,652 B2
(45) Date of Patent: Aug. 15, 2006

(54) METHOD OF MANUFACTURING FLIP CHIP RESISTOR

(75) Inventors: Leonid Akhtman, Shani (IL); Sakaev Matvey, Arad (IL)

(73) Assignee: Vishay Intertechnology, Inc., Malvern, PA (US)

( * ) Notice: Subject to any disclaimer, the term of this patent is extended or adjusted under 35 U.S.C. 154(b) by 0 days.

(21) Appl. No.: 10/440,941

(22) Filed: May 19, 2003

(65) Prior Publication Data

US 2004/0041278 A1 Mar. 4, 2004

Related U.S. Application Data

(62) Division of application No. 10/233,184, filed on Sep. 3, 2002, now Pat. No. 6,727,798.

(51) Int. Cl.
*H01C 17/00* (2006.01)

(52) U.S. Cl. ..... 29/610.1; 29/619; 29/620; 338/307

(58) Field of Classification Search ..... 29/610.1, 29/611–612, 619–621; 338/309–314, 328–333; 427/101–103; 257/536, 775
See application file for complete search history.

(56) References Cited

U.S. PATENT DOCUMENTS

| | | | | |
|---|---|---|---|---|
| 5,450,055 | A | 9/1995 | Doi | |
| 5,815,065 | A * | 9/1998 | Hanamura | 338/309 |
| 6,023,217 | A * | 2/2000 | Yamada et al. | 338/309 |
| 6,153,256 | A * | 11/2000 | Kambara et al. | 427/103 |
| 6,238,992 | B1 | 5/2001 | Yamada | |
| 6,314,637 | B1 * | 11/2001 | Kimura et al. | 29/620 |
| 6,492,896 | B1 * | 12/2002 | Yoneda | 338/309 |
| 6,609,292 | B1 * | 8/2003 | Kurita | 29/610.1 |
| 6,727,798 | B1 * | 4/2004 | Akhtman et al. | 338/309 |
| 2002/0148106 | A1 * | 10/2002 | Tsukada et al. | 29/610.1 |

FOREIGN PATENT DOCUMENTS

| | | |
|---|---|---|
| DE | 31 22612 A1 | 12/1982 |
| EP | 0 810 614 A1 | 12/1997 |
| EP | 0810614 | 12/1997 |
| EP | 1 018 750 A1 | 7/2000 |
| JP | 06275401 | 9/1994 |
| JP | 08031603 | 2/1996 |

OTHER PUBLICATIONS

Panasonic, "Fillet Less Thick Film Chip Resistors 0402".
Vishay Dale, Thick Film Chip Resistors, Military/Established Reliability MIL-PRF-55342/2/3/4/5/6/7/8/9/10 Qualified, Type RM.
Amitron, "Chip Resistors", 1998, p. 1.

* cited by examiner

*Primary Examiner*—Minh Trinh
(74) *Attorney, Agent, or Firm*—Mckee, Voorhees & Sease, P.L.C.

(57) ABSTRACT

The present invention provides for a method for manufacturing flip chip resistors by applying a first electrode layer to a substrate to create at least one pair of opposite electrodes, applying a resistance layer between each pair of opposite electrodes, applying a first protective layer at least partially overlaying the resistance layer, applying a second protective layer at least partially overlaying at least a portion of the resistance layer, and applying a second electrode layer overlaying the first electrode layer, a portion of the resistance layer, and at least a portion of the second protective layer. The present invention provides for higher reliability performance and enlarging the potential soldering area despite small chip size.

8 Claims, 2 Drawing Sheets

METHOD OF MANUFACTURING FLIP CHIP RESISTOR

CROSS-REFERENCE TO RELATED APPLICATIONS

This application is a divisional of U.S. Ser. No. 10/233,184 filed Sep. 3, 2002 now U.S. Pat. No. 6,727,798.

BACKGROUND OF THE INVENTION

Conventional surface mount resistors have wrap-around terminals on the ends of the resistor. When such surface mount resistors are soldered to a printed circuit board, solder covers entire surface of the terminals forming a fillets, resulting in occupation of an additional area for mounting. One example of such a conventional surface mount resistor is found in EPO 0810614A1 to Hashimoto et al. A flip chip resistor is a resistor that has no side electrodes and is soldered with its printed side towards the printed circuit board. With this configuration, the solder fillets are not formed thus decreasing the amount of circuit board space required and increasing the mounting density particularly in the case of small chip sizes.

Two examples of prior art flip chip resistors are shown in FIGS. 1 and 2. The flip chip resistor shown in FIG. 1 is described in U. S. Pat. No. 6,023,217 to Yamada et al. The flip chip resistor of FIG. 1 improves the quality of mounting and insulation between the printed layers of the resistor and a printed circuit board which is important when there is a printed circuit board trace running between the terminations.

A second prior art attempt at a flip chip resistor is shown in FIG. 2. The device shown in FIG. 2 has been offered by a number of chip manufacturers.

Both of these prior art flip chip resistors have problems. In particular, the area of conductive layers disposed under the joint of a protective overcoat layer and plated Nickel barrier disposed over a Silver electrode is subjected to destructive influence of environmental conditions more than other inner parts of the flip chip resistor because this joint is usually not sufficiently hermetic. This results in reduced reliability, especially in cases of face down mounting when residual flux cannot be reliably removed from the overcoat surface. Therefore, these flip chip resistors require expensive conductive materials based on noble metals (i.e. Pd, Au, Pt) for the top conductive layers in order to prevent erosion of the conductive layers.

A further problem with these configurations is that the pads provided are too small for reliable soldering. This problem becomes even more important in the case of small chip sizes. The pad areas in these prior art designs can only be enlarged when the resistance layer size is changed. Such a change interferes with requirements for laser trimming. Therefore, problems in the art remain.

Thus, it is a primary object of the present invention to improve upon the state of the art.

Another object of the present invention is to provide a flip chip resistor with high reliability.

Yet another object of the present invention is to provide a flip chip resistor that can be manufactured at a low cost.

As a further object of the present invention to provide a flip chip resistor that can be manufactured in small chip sizes.

A further object of the present invention is to provide a flip chip resistor that allows for sufficiently large pads for reliable soldering even when the flip chip resistor is of small size.

These and other objects, features and advantages of the present invention will become apparent from the description and claims that follow.

SUMMARY OF THE INVENTION

The present invention relates to a flip chip resistor.

According to one aspect of the invention, the flip chip resistor includes a substrate having opposite ends, a pair of electrodes, formed from a first electrode layer disposed on the opposite ends of the substrate, a resistance layer electrically connecting the pair of electrodes, a protective layer overlaying the resistance layer, and a second electrode layer overlaying the first electrode layer and at least a portion of the protective layer and optionally a portion of the resistance layer. A plating layer can then be overlayed on the second electrode layer to provide for solder attachment to a printed circuit board. This allows the flip chip resistor to be surface mounted with the resistance layer positioned towards the printed circuit board and results in high reliability.

According to another aspect of the present invention, a method of manufacturing flip chip resistors is provided. The method includes applying a first electrode layer to a substrate to create pairs of opposite electrodes, applying a resistance layer between each pair of opposite electrodes, applying a first protective layer at least partially overlaying the resistance layer, applying a second protective layer at least partially overlaying at least a portion of the resistance layer, and applying a second electrode layer overlaying the first electrode layer and at least a portion of the second protective layer. The substrate can then be divided to form individual flip chip resistors.

The present invention provides for an array of resistors to be manufactured using the above method. In a resistor chip array, multiple flip chip resistors are disposed on the same substrate.

The configuration of the present invention increases reliability of flip chip resistors, does not require expensive conductive materials for the electrode layers, and is especially advantageous in the case of small chip sizes as pad areas or electrode areas are large enough to promote reliable soldering.

DETAILED DESCRIPTION OF THE INVENTION

Figure 1:
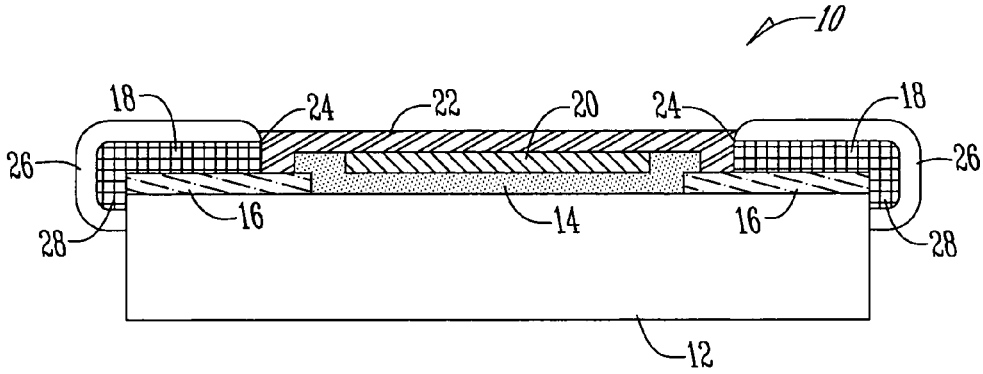
Fig. 1 (PRIOR ART)
FIG. 1 is a cross section of a prior art flip chip resistor.
Figure 2:
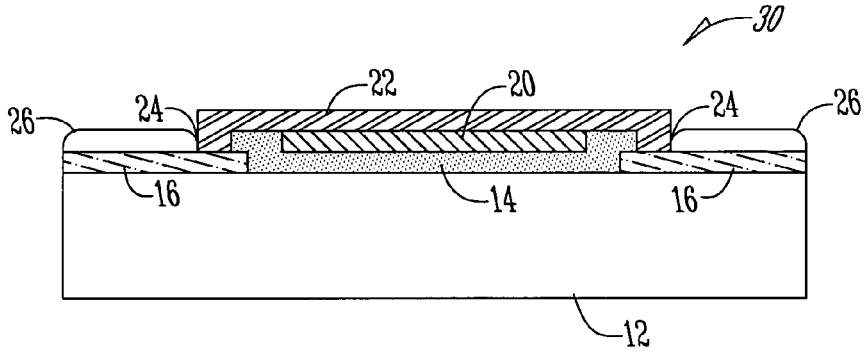
Fig. 2 (PRIOR ART)
FIG. 2 is a cross section view of another prior art flip chip resistor.

The present invention provides for a flip chip resistor. FIGS. 1 and 2 show prior art flip chip resistors illustrated for comparison purposes. The prior flip chip resistor 10 of FIG. 1 and the prior art flip chip resistor 30 of FIG. 2 both include a substrate 12 with a resistance layer 14 on the substrate 12. A first surface electrode layer 16 is shown. In addition, in FIG. 1, the prior art flip chip resistor 10 includes a second electrode layer 18. A first protection layer 20 and a second protection layer 22 are also shown. The electrode layers are covered by a plating 26. In both the prior art flip chip resistors, a junction 24 is shown. The junction 24 is a junction between the second protection layer 22 and the plating layer 26. It is this junction that is normally the weak point due to environmental conditions that result in reduced reliability. Further, with respect to the prior art flip chip resistor 30 of FIG. 2, the soldered area available is limited by the requirements of the resistance layer 14.

Figure 3:
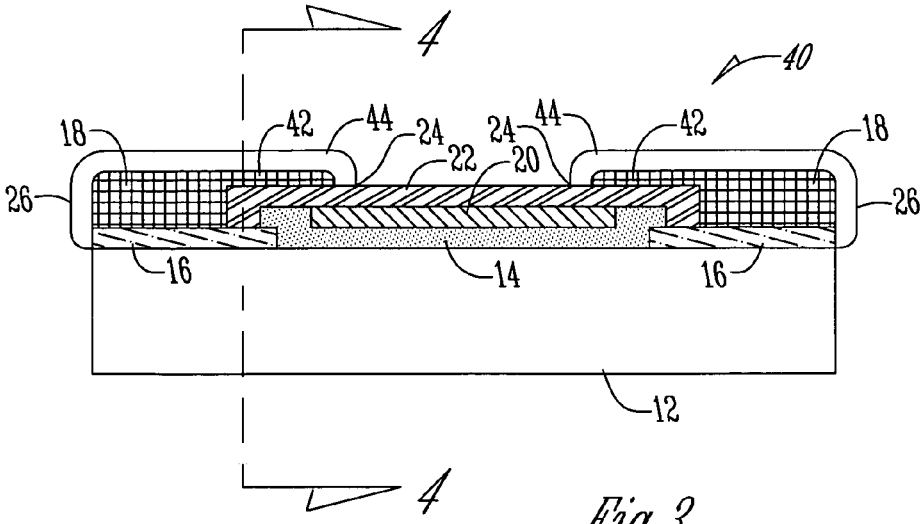
FIG. 3 is a cross section of a flip chip resistor according to one embodiment of the present invention.

FIG. 3 provides a section view of one embodiment of the present invention. In FIG. 3, the second electrode layers 18 are extended along the protection layer 22 so that the junction 24 between the plating 26 and the second protection layer 22 is not disposed over the first electrode layer 16. In FIG. 3, a flip chip resistor 40 is shown. The flip chip resistor 40 shown includes a substrate 12. The present invention contemplates numerous types of materials being used for the substrate 12. For example, the substrate 12 can be of various ceramic materials. Overlaying the substrate 12 is a resistance layer 14. The resistance layer 14 electrically contacts electrodes. Electrodes as shown are formed from a first surface electrode layer 16 and a second electrode layer 18. A first protection layer 20 overlays at least a portion of the resistance layer 14. A second protection layer 22 overlays the first protection layer 20. A plating 26 overlays each of the electrodes. As shown in FIG. 3, the junction 24 is disposed over a solid surface of the second protection layer 22. Thus the first electrode layer 16 is not exposed to environmental conditions resulting in increased reliability for the resistor. The second electrode layer 18 includes a portion 42 that extends at least partially over the second protection layer 22 and the resistance layer 14. Due to this configuration, the size of the soldered pads or plating area 26 is not restricted by the size of the resistance layer 14 such as occurs in the prior art of FIG. 2. As shown in FIG. 3, a portion of the plating 44 extends over a portion of protective layer 22 and a portion on the resistance layer 14 so that the plating area 26 can be increased in size.

Figure 4:
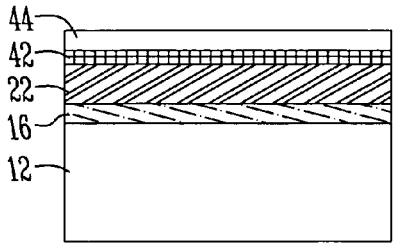
FIG. 4 is a section view taken along line 4—4 of FIG. 3 of a flip chip resistor according to one embodiment of the present invention.

FIG. 4 provides a section view taken along line 4—4 of FIG. 3. As shown in FIG. 4, a substrate 12 is shown with a first surface electrode layer 16 overlaying the substrate 12. A second protection layer 22 overlays the first electrode layer 16. A portion of the second electrode layer 42 overlays the second protection layer 22. A portion of plating 44 overlays the portion of the second electrode layer 42.

Figure 5:
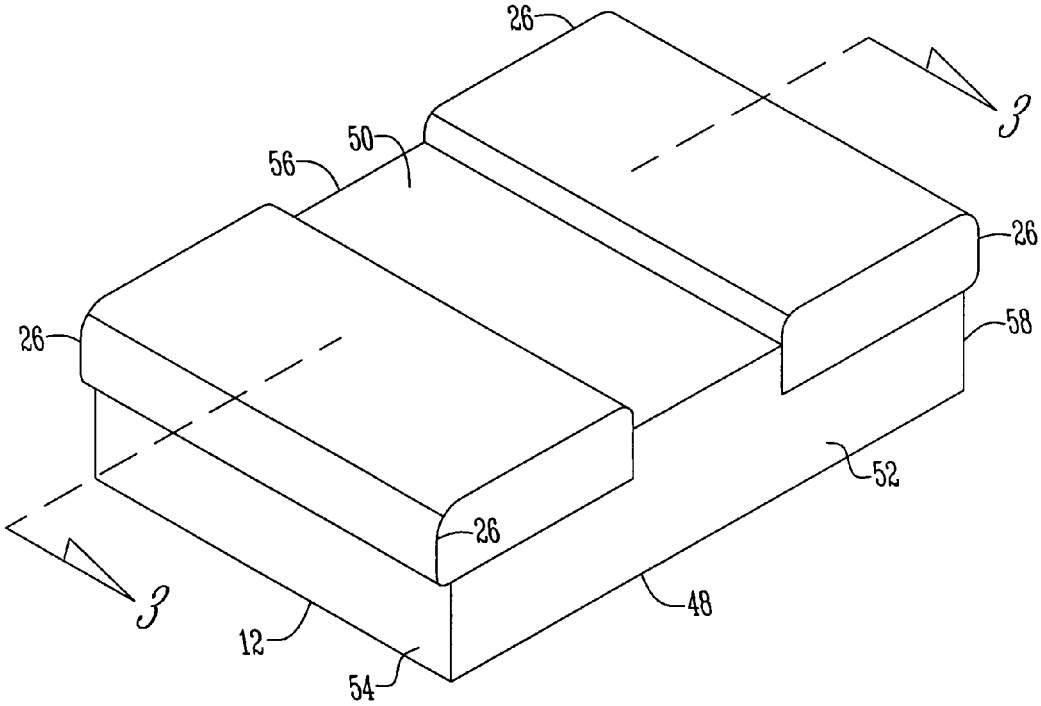
FIG. 5 is a perspective view of one embodiment of a flip chip resistor according to the present invention.

FIG. 5 provides a perspective view of one embodiment of a flip chip resistor according to the present invention. FIG. 3 is a section view taken along line 3—3 of FIG. 5. In FIG. 5, the flip chip resistor includes a bottom side 48, a top side 50, opposite sides 52, 56 and opposite ends 54, 58. The plated portions 26 of first and second electrodes are positioned opposite each other on the top surface 50 of the flip chip resistor. This allows the flip chip resistor to be solder mounted to a printed circuit board in a manner that reduces the amount of board space required. Further, the flip chip resistor of the present invention is particularly useful for small chip sizes because, as shown in FIG. 5, the solder pad or plating 26 areas are not limited by the size of the resistance layer and thus can be made sufficiently large to promote proper and reliable soldering of a flip chip resistor to a printed circuit board.

The present invention contemplates numerous variations in the materials and/or processes used. For example, the flip chip resistor of the present invention can be a thick film resistor or a thin film resistor. The substrate may be of various types, including being of various ceramic materials. The protective layer or layers of the present invention can be of various materials including, but not limited to resin materials. Similarly, the second conductive layers can be made of various materials, including but not limited to electroconductive polymers or electroconductive resin materials. The plating 26 can also be of various conductive materials, including but not limited to Nickel, Nickel alloys, and other metals and/or alloys. These and other variations are fully contemplated by the present invention.

The present invention also provides for a method of manufacturing a flip chip resistor. The present invention contemplates that such a method can be used to manufacture arrays of flip chip resistors. According to one embodiment of such a method, a first electrode layer is formed on a substrate to create a pair of opposite electrodes. A resistance layer is then applied between each layer of opposite electrodes, the resistance layer electrically connecting each pair of opposite electrodes. A first protective layer is applied at least partially covers the resistive layer. The resistance layer can be trimmed to an ordered value or otherwise desirable value by forming grooves in the resistance layer. A second protective layer is then applied that at least partially overlays a portion of the resistance layer. Then, a second electrode layer is applied that overlays the first electrode layer at least a portion of the second protective layer.

The substrate used can be a sheet-shaped substrate that is either prescored or unscored. Where a sheet-shaped substrate is used, the substrate can then be divided into individual flip chip resistors. Where an unscored sheet-shape substrate is used, the substrate can be divided into individual chips by dicing. Then, the second electrode layer of each flip chip resistor is plated.

Thus, in this manner, the present invention provides for a method of manufacturing a flip chip resistor. In particular, the method of manufacture of the flip chip resistor can be used to manufacture arrays of flip chip resistors. The present invention contemplates variations in the manner in which the various layers are applied, the types of materials, and other variations.

What is claimed is:

1. A method of manufacturing flip chip resistors, comprising:

applying a first electrode layer to a top surface of a substrate to create at least one pair of opposite first electrodes;

applying a resistance layer between each pair of opposite first electrodes;

applying a first protective layer at least partially overlaying the resistance layer;

applying a second protective layer at least partially overlaying at least a portion of the resistance layer, the second protective layer having a top surface;

applying a second electrode layer overlaying and in contact with the first electrode layer, the second electrode layer extending inwardly to directly overlay a portion of the resistance layer, and the second electrode layer overlaying and in contact with a portion of the top surface of the second protective layer to form at least one pair of opposite second electrodes corresponding to the at least one pair of opposite first electrodes; and wherein an innermost junction between the second protective layer and each of the second electrodes is positioned inward of the first corresponding electrode.

2. The method of claim 1 further comprising dividing the substrate into individual flip chip resistors.

3. The method of claim 1 further comprising trimming the resistance of the resistance layer.

4. The method of claim 1 further comprising plating the second electrode layer of each flip chip resistor, the plating extending over a portion of the top surface of the second protective layer.

5. The method of claim 1 wherein the substrate is an unscored sheet-shaped substrate and the step of dividing is performed by dicing.

6. The method of claim 1 wherein the substrate is an unscored sheet-shaped substrate and the step of dividing is performed by laser scribing.

7. A method of manufacturing flip chip resistors to provide flip chip resistors with pad areas which are sizeable independently from a resistance layer, comprising:

applying a first electrode layer to a top surface of a substrate to create at least one pair of opposite electrodes;

applying the resistance layer between each pair of opposite electrodes;

applying the first protective layer at least partially overlaying the resistance layer;

applying a second protective layer having a top surface and at least partially overlaying at least a portion of the resistance layer;

applying a second electrode layer directly overlaying and in contact with the first electrode layer, directly overlaying a portion of the resistance layer, and directly overlaying and in contact with a portion of the top surface of the second protective layer, the second electrode layer extending inwardly beyond the first electrode layer;

plating the second electrode layer to provide the pad areas such that size of the pad areas is independent of size of the resistance layer; and wherein an innermost junction between the second protective layer and the second electrode layer is positioned inward of the first electrode.

8. A method of manufacturing a flip chip resistor, comprising:

applying a first electrode layer to a top surface of a substrate to create at least one pair of opposite electrodes;

applying the resistance layer between each pair of opposite electrodes;

applying a first protective layer at least partially overlaying the resistance layer;

applying a second protective layer having a top surface and at least partially overlaying at least a portion of the resistance layer;

applying a second electrode layer which overlays and contacts the first electrode layer, and directly overlays a portion of the resistance layer and directly overlays and contacts a portion of the top surface of the second protective layer to form at least one pair of opposite second electrodes; and wherein a portion of each of the second electrodes extends inwardly beyond the corresponding first electrode and inwardly beyond and directly over the resistance layer.

* * * * *